United States Patent [19]

Sutherland

[11] Patent Number: 4,498,618

[45] Date of Patent: Feb. 12, 1985

[54] LOCK ARRANGEMENT BETWEEN TWO CARTON CLOSURE PANELS

[75] Inventor: Robert L. Sutherland, Campbell Hall, N.Y.

[73] Assignee: Federal Paper Board Co., Inc., Montvale, N.J.

[21] Appl. No.: 522,575

[22] Filed: Aug. 12, 1983

[51] Int. Cl.[3] ..... B65D 5/02

[52] U.S. Cl. ..... 229/40; 206/434

[58] Field of Search ..... 229/40, 33, 36, 48 R; 206/140, 427, 434; 217/3 FC

[56] References Cited

U.S. PATENT DOCUMENTS

| | | | |
|---|---|---|---|
| 3,181,727 | 5/1965 | Graser et al. | 229/40 X |
| 3,384,291 | 5/1968 | Graser | 229/40 |
| 3,767,042 | 10/1973 | Ganz | 229/40 X |
| 3,945,560 | 3/1976 | Harrelson et al. | 206/140 X |
| 4,433,806 | 2/1984 | Ganz et al. | 229/40 |
| 4,433,807 | 2/1984 | Ganz | 229/40 |

*Primary Examiner*—William Price
*Assistant Examiner*—Gary E. Elkins
*Attorney, Agent, or Firm*—Charles E. Brown

[57] ABSTRACT

This relates to a lock arrangement for locking together closure panels of cartons, particular cartons of the wrap around type. The lock arrangement includes a primary lock panel which carries a primary lock arrangement including a projecting primary locking tab which is disposed on one side of a semicircular cut out or aperture and wherein there is a locking ear on the opposite side of the aperture. The other closure panel, which is the inner closure panel carries a secondary lock arrangement which includes a secondary locking tab which is connected to the secondary flap along a hinge line and is separated therefrom by an offset partial cut line so as to define a locking shoulder.

When the lock arrangement is formed, the primary locking tab is locked behind a shoulder on the inner closure panel defined by the displacement of the secondary flap and the primary locking tab extends through the aperture and is locked behind the locking ear. The primary locking tabs and the secondary tabs are disposed in side by side relation with the secondary locking tab projecting generally normal to the closure panels and projecting between adjacent containers so as to hold the containers apart. The secondary flap is of a width at least equal to the overall width of the primary lock arrangement.

16 Claims, 7 Drawing Figures

LOCK ARRANGEMENT BETWEEN TWO CARTON CLOSURE PANELS

This invention in general relates to new and useful improvements in cartons of the wrap around type wherein two terminal carton panels are locked together, generally at the bottom of the carton.

This invention in particular relates to a a new lock arrangement wherein a primary locking panel is provided with a generally semi circle aperture or cut out for receiving a secondary locking tab and has on one side thereof a primary locking tab and at the opposite side thereof a locking shoulder. The primary locking panel has associated therewith a secondary locking tab carried by a secondary flap which overlaps the primary locking panel and wherein the secondary locking tab extends through the aperture or cut out and locks behind the locking shoulder.

When the closure panels are locked together, the primary locking tab and the secondary tab are disposed in side by side relation.

Another feature of the invention is that the secondary flap is of a width to be aligned with and overlying all of the primary lock.

With the above and other objects in view that will hereinafter appear, the nature of the invention will be more clearly understood by reference to the following detailed description, the appended claims, and the several views illustrated in the accompanying drawings.

Figure 1:
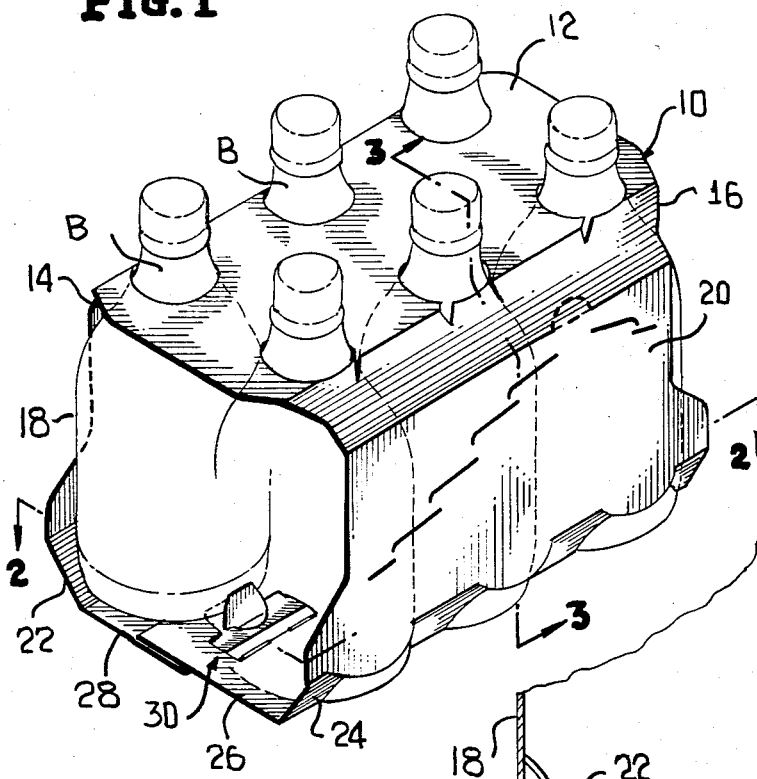
FIG. 1 is a perspective view of a customary type of six-pack wrap around carton with bottles therein and closure panels of the carton being interlocked utilizing the lock arrangement of this invention.

In FIG. 1 there is shown a carton of the wrap around type which incorporates the lock arrangement which is the subject of this invention, the carton being generally identified by the numeral 10. The carton 10 is particularly adapted for forming a package of six bottles B arranged in two rows. The carton 10 includes a top panel 12 which is provided at opposite sides thereof with shoulder panels 14, 16, which, in turn have connected thereto side panels 18, 20, respectively. The side panels 18, 20 terminate in sloping bottom interlocking panels 22, 24, respectively. The bottom locking panel 24 carries an inner closure panel 26 while the bottom locking panel 22 carries an outer closure panel 28. The closure panels 26, 28 are secured together by a plurality of lock arrangements 30 of which are the subject of this invention, there being one lock arrangement 30 for each transverse pair of bottles B.

Figure 6:
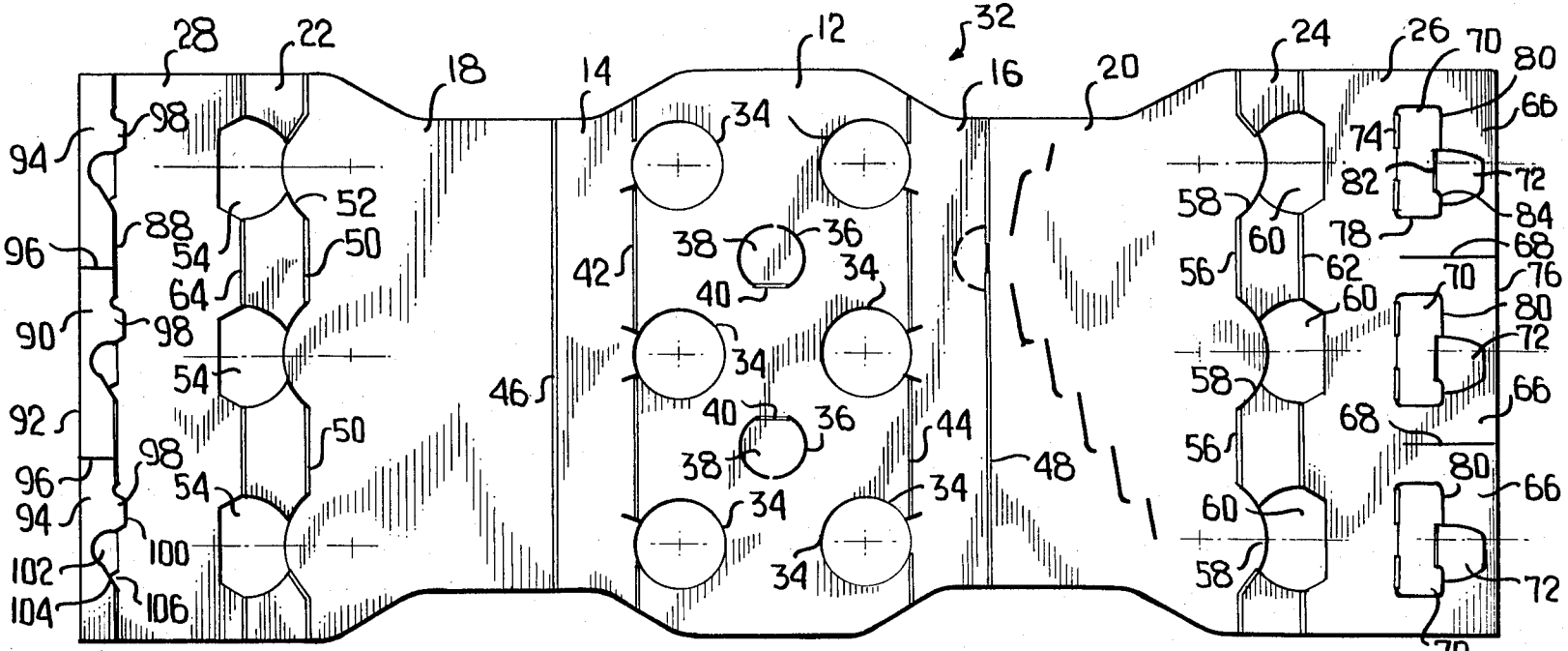
FIG. 6 is a plan view of a blank from which the carton of FIG. 1 is formed.

Referring now to FIG. 6, it will be seen that there is illustrated a blank 32 from which the carton 10 is formed. The blank 32 defines in the central portion thereof the top panel 12. The top panel is provided with a plurality of openings 34, there being one opening 34 for each of the bottles B. There is also formed in the top panel 12 between each arrangement of the four openings 34 finger receiving apertures 36 which are defined by pressing in panel pushers 38 which are connected to the top panel 12 along hinge lines 40.

The shoulder panel 14 is connected along one edge of the top panel 12 by a fold line 42 while the shoulder panel 16 is connected along the opposite edge of the top panel 12 along a fold line 44.

The side panel 18 is connected along the other edge of the shoulder panel 14 along a fold line 46 while the side panel 20 is connected to the outer edge of the shoulder panel 16 along a fold line 48.

Figure 3:
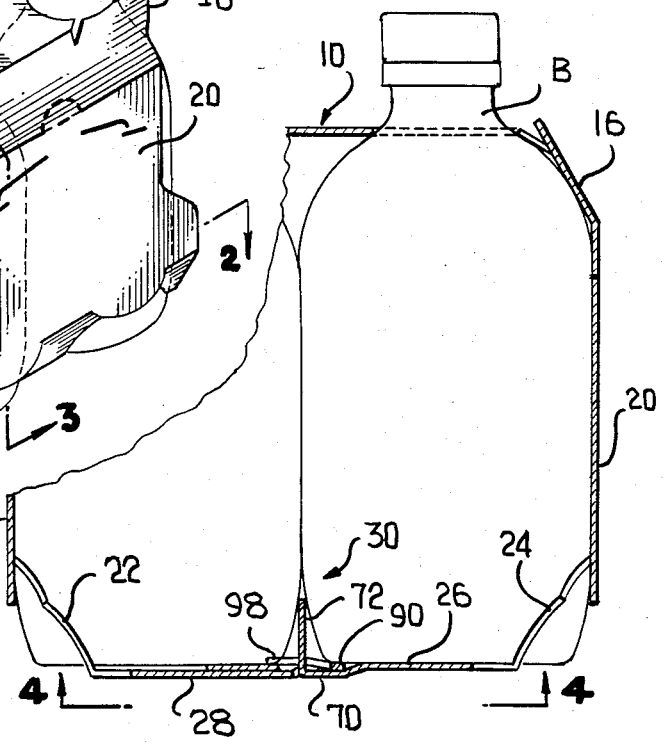
FIG. 3 is a fragmentary transverse vertical sectional view taken generally along the line 3—3 of FIG. 1 and shows further the details of the lock arrangement.
Figure 2:
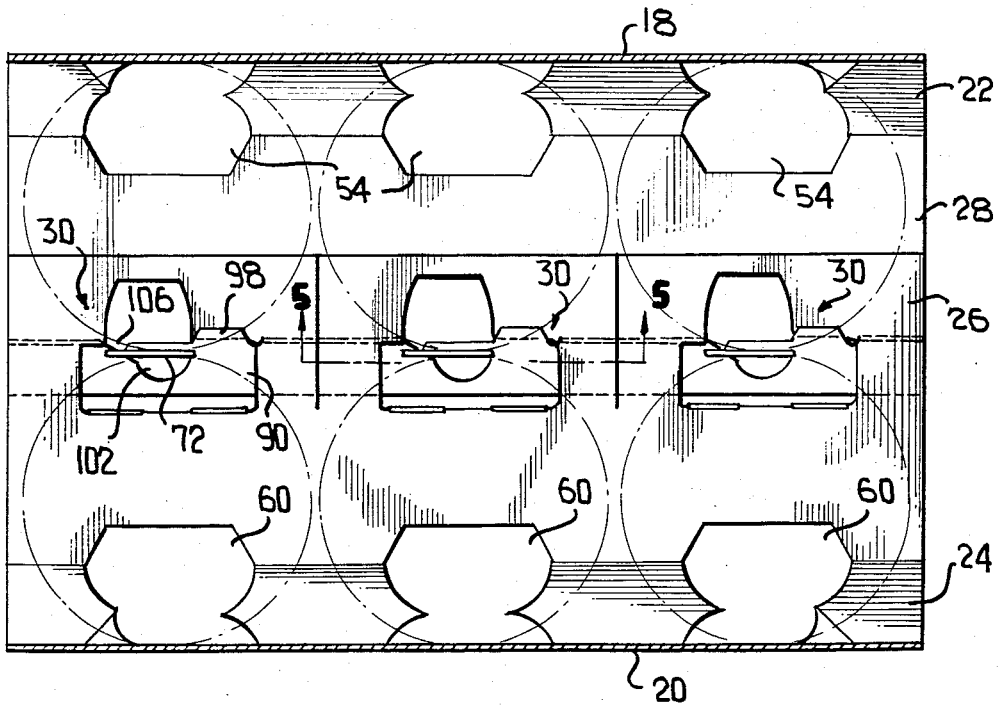
FIG. 2 is a horizontal sectional view taken generally along the line 2—2 of FIG. 1 of the carton per se and so is the lock arrangment as viewed from the interior of the carton.

The bottom locking panel 22 is of a conventional construction and is connected to the side panel 18 along a series of interrupted fold lines 50, the fold line 50 being interrupted by arcuate cuts 52 and there being openings 54 in the bottom lock panel 22 for receiving bottom corner portions of bottles B in interlocking relation as is best shown in FIG. 3. A similar interrupted fold line 56 extends between the bottom lock panel 24 and side panel 20 with the fold line 56 being interrupted by arcuate cuts 58. Associated with the arcuate cuts 58 are other apertures or openings 60 for receiving the bottom corners of bottles B.

The inner closure panel 26 has portions of the apertures 60 extending thereinto and is joined to the bottom lock panel 24 along interrupted fold line portions 62. In a like manner, the other closure panel 28 has the apertures 54 extending thereinto and is joined to the bottom lock panel 22 along fold line portions 64.

The inner closure panel 26 is provided with a plurality of separate portions 66 which are divided by cut lines 68. Each separate inner closure panel portion 66 is provided with a secondary lock component which includes a secondary flap 70 which carries a secondary locking tab 72. The secondary flap 70 is hingedly connected to the inner closure panel 66 along a fold line 74 which is disposed remote from a free edge 76 of the inner closure panel 26. The secondary flap 70 and the secondary locking tab 72 are defined by a cut line arrangement 78 of which a portion adjacent the secondary tab 72 defines a locking shoulder for a primary locking tab to be described in detail hereinafter.

At this time it is pointed out that the secondary locking tab 72 is offset to one side of the secondary flap 70 and is connected to the secondary flap 70 primarily along a hinge line 82. However, that portion of the secondary locking tab 72 remote from the shoulder 80 is separated from the secondary flap 70 by a cut line 84 which is offset from the hinge line 82 so as to both define a shoulder 86 (FIG. 5) on the secondary locking tab 72 and to space the shoulder from the secondary flap 70 when the secondary locking tab 72 is disposed in angular relation to the secondary flap 70.

The outer closure panel 28 carries along an interrupted hinge line 88 a primary locking panel 90 having a free edge 92. The primary locking panel 90 is divided into a plurality of separate portions 94 by cut lines 96.

Each primary locking panel portion 94 is provided with a primary lock portion which includes a primary locking tab 98 defined by a cut line 100 projecting into the outer closure panel 28. Immediately adjacent to the primary locking tab 98 is a generally semicircular cut out or aperture 102. Next to the aperture 102 is a sloping cut line 104 extending from a side portion of the aperture 102 in a sloping relation with respect to the hinge line 88 with the cut line 104 defining a locking ear 106 for the secondary locking flap 72.

When the carton 10 is assembled with the bottles B and wrapped thereabout, the inner closure panel 26 is first folded beneath the bottles B with the secondary flap 70 and the primary locking flap arranged in depending relation. Then the outer closure panel 28 is folded into position with the primary locking panel 90 folded with respect thereto so that the primary locking tabs 98 may enter into the apertures defined by striking out the secondary flap 70 and engaged behind the respective shoulders 80. Then the secondary flaps 70 are moved up towards the primary locking panel 90 with the secondary locking flap 72 passing through the apertures 102 and through the opening defined by the adjacent cut line 104 until the shoulder 86 on each secondary locking tab 72 passes entirely through the outer enclosure panel 28 and its associated primary locking panel 90 and locked behind the respective locking ear 106 as is clearly shown in FIG. 5.

Returning now to FIG. 3, it will be seen that the secondary locking tab 72 projects vertically up into the interior of the carton 10 and is wedgedly engaged with lower portions of the bottles B to retain their generally in spaced relation and to divide them into two rows.

It is to be understood that the height of each secondary locking tab 72 will vary depending upon the specific type of container which is packaged and that the invention is in no way restricted to the illustrated bottles. Other containers, such as cans, jars, tubs, etc may be packaged in a similar manner. The heighth of the secondary locking tab 72 will control the width of the inner closure panel 26 and thus control the amount of board needed to form the blank 32.

Figure 7:
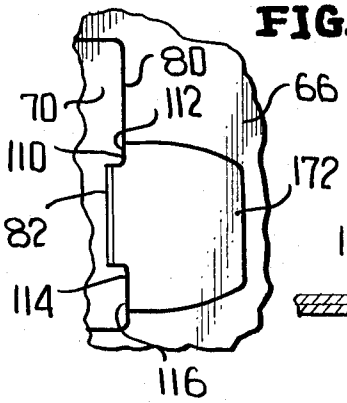
FIG. 7 is an enlarged fragmentary plan view of a modified locking tab.

Referring now to FIG. 7, it will be seen that there is illustrated a modified form of the secondary locking tab, which modified locking tab is identified by the numeral 172. The central portion of the locking tab 172 is hingedly connected to the associated secondary flap 70 along a fold line 82 in the same manner as described herein above with respect to the secondary locking tab 72.

The secondary locking tab 172 differs from the secondary locking tab 72 in 2 aspects. First of all, the secondary locking tab 172 extends both to the left and the right of the ends of the fold line 82 with the left part of the secondary locking tab 172 being separated from the secondary flap 70 by a cut line 110 so as to define a locking shoulder 112. The right portion of the secondary locking tab 172 extends further to the right beyond the fold line 82 than does the secondary locking tab 72. Thus the cut line 114 which separates the right portion of the secondary locking tab 172 from the secondary flap 70 is elongated as compared to the cut line 84 with the result that locking shoulder 116 which is longer than the locking shoulder 86 is provided.

Figure 5:
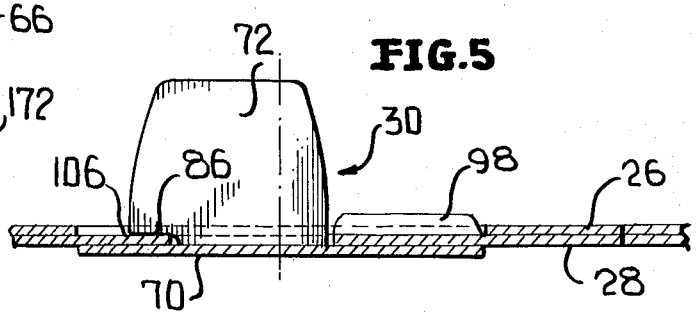
FIG. 5 is an enlarged fragmentary longitudinal vertical sectional view taken generally along the line 5—5 of FIG. 2 and shows specifically the details of the lock arrangement.

This time, it is pointed out that when the carton containing the secondary locking tabs 172 is erected and the carton is viewed as shown in FIG. 5, the shoulders 112 and 116 will be reversed.

It is also pointed out here that when the width of the secondary locking tab is increased, the width of the locking ear 106 should be increased by extending the cut line 104 into the outer closure panel 28 beyond the adjacent hinge line 88.

It will be readily apparent that by increasing the width of the secondary locking ear and by providing two locking shoulders, a much greater interlock will be obtained between the closure panels 26 and 28 which will increase the resistance of the lock to failure particularly under conditions wherein the carton is wet and is dropped.

Figure 4:
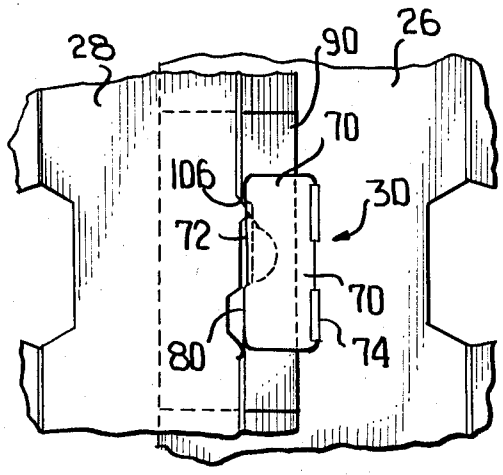
FIG. 4 is a fragmentary bottom plan view of the bottom of the carton.

It is particularly pointed out here that the width of each secondary flap 70 is at least equal to the overall width of each primary lock portion, i.e. the width of the primary locking tab 98, the aperture 102 and the locking ear 106 and will be aligned therewith. As is best shown in FIG. 4, each secondary flap 70 is generally aligned with the primary lock components and their relative extent of the secondary flap 70 and the primary lock component is clearly illustrated.

It is to be understood that the lock arrangement 30 provides for increased security especially for heavy product groupings like six-16 ox bottles and improved performance on wet drop testing. This is particularly important when using cylinder type cardboard in the United States and certain other countries which do not have the high wet strength of virgin Kraft board.

Although only a perferred embodiment of lock arrangment has been specifically illustrated and described herein, it is to be understood that various modifications may be made without departing from the spirit and scope of the invention as defined by the appending claims.

I claim:

1. A lock arrangement between two carton closure panels, one of said closure panels being an inner panel and the other of said closure panels being an outer panel, each of said closure panels having a free edge, said inner panel having struck therefrom a secondary flap hingedly connected to said inner panel remote from said inner panel free edge and carrying generally at one side thereof a secondary locking tab projecting towards said inner panel free edge, the striking of said secondary flap and said secondary locking tab define in said inner panel a locking aperture having at a side thereof remote from said secondary locking tab a primary locking shoulder facing away from said inner panel free edge, said outer panel carrying a primary locking panel generally along a hinge line, said primary locking panel carrying a primary locking tab struck from said outer panel and extending across said hinge line, locking means for said secondary locking tab spaced along said hinge line from said primary locking tab, and an aperture in said terminal flap between said primary locking tab and said locking means for said secondary locking tab, said secondary flap being aligned with and fully extending the width of said primary locking tab, said aperture in said primary locking panel and said locking means being of a combined dimension generally equal to the width of and being aligned with said secondary locking tab.

2. A lock arrangement according to claim 1 wherein said secondary locking tab extends substantially normal to said inner and outer panels beyond said inner panel for wedging engagement between two adjacent containers.

3. A lock arrangement according to claim 1 wherein said secondary flap is of a width at least equal to the combined width of said primary tab, said aperture in said primary locking panel and said locking means.

4. A lock arrangement according to claim 1 wherein said locking means is in the form of a cut line formed primarily in said primary locking panel and extending from that edge of said aperture in said primary locking panel remote from said primary locking tab towards said hinge line and defining a locking ear engageable between a portion of said secondary locking tab and said secondary flap to lock said secondary locking tab in place.

5. A lock arrangement according to claim 4 wherein said secondary locking tab is connected to said secondary flap along a hinge line and is in part separated from said secondary flap by a cut line forming generally an extension of said hinge line and defining a shoulder on said secondary locking tab for locking behind said locking ear.

6. A lock arrangement according to claim 5 wherein said cut line between said secondary locking tab and said secondary flap is at said one side of said secondary flap.

7. A lock arrangement according to claim 1 wherein said secondary locking tab is connected to said secondary flap along a hinge line and is in part separated from said secondary flap by a cut line forming generally an extension of said hinge line and defining a shoulder on said secondary locking tab for locking behind said locking means.

8. A lock arrangement according to claim 5 wherein said hinge line and said cut line between said secondary locking tab and said secondary flap are offset to space said shoulder from said secondary flap when said secondary locking tab is in angular relation to said secondary flap.

9. A lock arrangement according to claim 1 wherein said primary locking panel is divided into separate portions each including said primary locking tab, said aperture and said locking means and said inner panel having a secondary flap and a secondary locking tab for each of said primary locking panel portions.

10. A lock arrangement according to claim 1 wherein said secondary locking tab is positioned alongside said primary locking tab.

11. A lock arrangement according to claim 1 wherein said secondary locking tab is positioned alongside said primary locking tab and said secondary flap is disposed outwardly of said primary locking panel.

12. A lock arrangement according to claim 1 wherein said secondary flap is disposed outwardly of said primary locking panel.

13. A lock arrangement according to claim 9 wherein said inner panel is divided into portions similar to said portions of said primary locking panel.

14. A lock arrangement according to claim 1 wherein said aperture has one edge aligned with said hinge line.

15. A lock arrangement according to claim 1 wherein said aperture has one edge aligned with said hinge line and is semicircular in outline.

16. A lock arrangement according to claim 5 wherein there is a second cut line between said secondary locking tab and said secondary flap at the opposite end of said hinge line defining a second shoulder on said secondary locking tab to increase the strength of the interlock.

* * * * *